United States Patent [19]

Aghnides

[11] 4,365,755

[45] Dec. 28, 1982

[54] AERATOR WITH REDUCED NOISE

[76] Inventor: Elie P. Aghnides, 2 E. 61st St., New York, N.Y. 10021

[21] Appl. No.: 221,475

[22] Filed: Dec. 30, 1980

[51] Int. Cl.[3] ..... E03C 1/08

[52] U.S. Cl. ..... 239/428.5

[58] Field of Search ..... 239/428.5, DIG. 18; 261/DIG. 22

[56] References Cited

U.S. PATENT DOCUMENTS 2,998,929 9/1961 Aghnides ..... 239/428.5

2,998,931 9/1961 Aghnides ..... 239/DIG. 18 X

FOREIGN PATENT DOCUMENTS 986142 3/1965 United Kingdom ..... 239/428.5

*Primary Examiner*—Andres Kashnikow

*Attorney, Agent, or Firm*—William D. Hall

[57] ABSTRACT

An aerator which considerably reduces the noise, as measured in an adjacent room, resulting from a water flow through a faucet aerator, is disclosed. The aerating disc which directs the water upon one or more screens is preferably about 1.75 mm thick, and has at least 36 water passages (which may be called chambers) through the disc. The water passages or chambers are parallel to the general direction of flow of water through the aerator and have a cross-section no greater than 0.8 mm$^2$. The upstream entrance to each chamber comprises at least two entrance openings, the aggregate cross-section of which openings is at least equal to the cross-section of the chamber.

9 Claims, 5 Drawing Figures

AERATOR WITH REDUCED NOISE

BACKGROUND OF THE INVENTION

Water flow through an aerator produces noise which is transmitted through the water and/or the water pipe for a considerable distance. Hence, if the water pipe is in good contact with the wall of an adjacent room, the noise created by the aerator may be readily audible in the adjacent room. In at least one jurisdiction (Germany), there is a regulation limiting the amount of noise that the aerator may produce in an adjacent room. Existing aerators, such as are used in the United States, create noise considerably exceeding the standards set in Germany, and considerable research has been undertaken in an effort to produce an aerator that meets German noise requirements. At least one other inventor has devised an aerator which meets the low noise requirements but his low-noise aerator is very expensive since it employs six screens to get the desired soft bubbly stream and at the same time meet the low noise requirements.

The object of the present invention is to make a low-noise and simple in construction aerator that satisfies the low-noise requirements.

In my U.S. Pat. No. 2,998,929, entitled "Water Aerator", granted Sept. 5, 1961, I have illustrated an aerator which has an upstream disc having a number of chambers which receives the water and directs water streamlets onto a single downstream screen. Each chamber has a restricted entrance opening at its upstream end. A number of my prior patents employ at least two opposing restricted openings at the upstream end of the chamber. In all such patents, however, it was contemplated that the entrance or entrances to the chamber would be restricted, in the sense that the aggregate cross-section of the entrance openings would be less than the cross-section of the chamber. Furthermore, the number of chambers was somewhat limited, for example, in my aforesaid U.S. Pat. No. 2,998,829, it was suggested that the disc might have 29 (more or less) holes or chambers.

SUMMARY OF THE INVENTION

According to my present invention an aerator is constructed along the lines of my U.S. Pat. No. 2,998,929, referred to above, except that the number of chambers is considerably increased, their cross-sections are substantially decreased, and the entranceways to the chambers have an aggregate cross-section at least as large as the cross-section of the chamber. The combination of these factors considerably reduces the noise produced by the water flowing through the aerator. In the detailed description of the invention, a number of typical examples setting forth the number and size of the chambers as well as the size of the entrance openings is set forth.

However, one example is as follows: (a) The thickness of the upstream disc may be 1.75 mm., which means that each chamber will have that height; (b) the chambers form three concentric rows—the inner row has 10 chambers—the middle row has 18 chambers—and the outer row has 22 chambers, making a total of 50 chambers; (c) each such chamber has a square cross-section with each side 0.6 mm. long thus providing a cross-section for the chamber of 0.36 $mm^2$; (d) each chamber has two entrance openings at its upstream end, and each entrance opening has dimensions of 0.45 mm$\times$0.50 mm., in other words, a cross-section of 0.225 $mm^2$; and (e) since there are two such entrance openings for the chamber, the aggregate cross-section of the entrance openings is 0.45 $mm^2$ which is larger than the 0.36 $mm^2$ cross-section of the chamber. As a result, the chamber is full of water; nevertheless, the water is turbulated in the chamber by the mixing action created by the opposing entrance openings, and therefore, the water discharged from each chamber has impaired coherence so that it will pick up air on its way to the aerating screen, and create a better mixing action at the aerating screen. As a result only one or two aerating screens are required. Such an aerator has the reduced noise requirements required to meet existing requirements in Germany, and considerably lower noise than the aerators on the market in the United States.

DETAILED DESCRIPTION OF THE INVENTION

The noise produced by aerators in Germany must be below certain levels, for example, 15 db, when measured according to the procedures outlined in certain documents entitled: UDC 699.844: 696.1:696.4:620.1:534.6 DEUTSCHE NORMEN, *Testings in Building Acoustics,* Laboratory Testings on the Noise emitted by Valves, Fittings and Appliances used in Water Supply Installations, Method of Measurement and Test Arrangement, DIN 52 218, Part 1, December 1976, and UDC 699.844:696.1:696.4:620.1:534.6 DEUTSCH NORMEN, *Testings in Building Acoustics,* Laboratory Testings on the Noise Emitted by Valves, Fittings and Appliances used in Water Supply Installations, Connection of Applicances and Test Procedure, DIN 52 218, Part 2, December 1976. These documents set forth the test procedure for testing the noise produced by an aerator.

Figure 1:
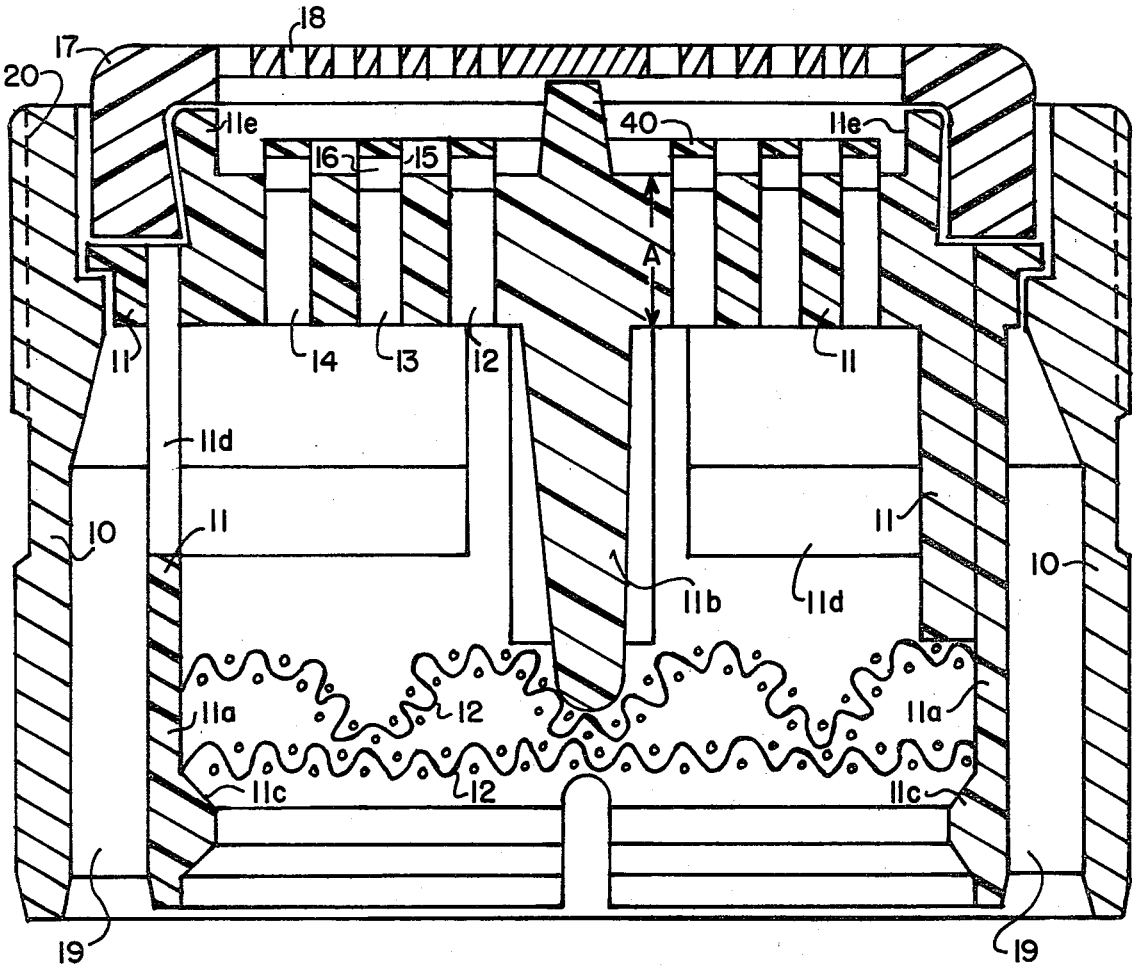
FIG. 1 is a cross-section of an aerator of the type to which the invention is applied.
Figure 2:
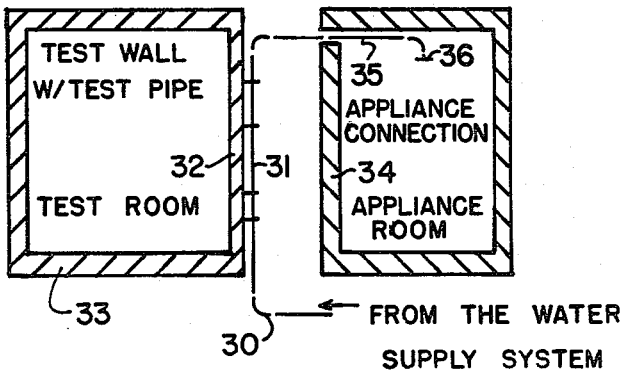
FIG. 2 illustrates test apparatus for testing the noise produced by an aerator.

FIG. 2 of this application is taken from page 2 of Part 1 of said document and shows briefly the test procedure for testing the noise created by an aerator. In that test procedure, water from a supply system enters pipe 30 which has a straight portion 31 attached to the test wall 32 of a test room 33, and it then passes via pipe 35 to the faucet (with aerator) 36. The noise created by the aerator is transmitted via the water and/or the pipe to the test wall 32. The vibrations of the test wall due to noise produced by the aerator creates noise in the room 33 which is measured by suitable instruments. The details of the test procedure are described in the documents identified in the immediately preceding paragraph of this specification. These documents are incorporated in this application by reference, and a copy of each is in the file wrapper of this application as part of the Prior Art Statement filed on even date with this application.

When measured by the test procedure set forth in said documents, the noise produced by a typical commercial prior art aerator is 18 db, whereas the regulations call for a noise level not greater than 15 db. With the invention of this application, the noise level may be reduced to as low as 11 or 12 db.

In carrying out the invention, I employ an aerator having the customary metal casing 10 together with a disc and screen which are superficially similar in construction to the one shown in my U.S. Pat. No. 2,998,929 referred to above. However, the present invention differs from my prior patents in respect to the number of chambers, their size, and the size of the entrance openings, to reduce the noise created by the aerator.

The upstream disc 11 is supported by the metal casing 10. The disc 11 has a depending skirt 11*a*, a central projection 11*b* for holding the screen in place, a ledge 11*c* for supporting the screen, and air slots 11*d* for allowing air to enter the mixing space. Projections 11*e* are integral with the disc 11.

The disc 11 has three concentric rows of chambers 12, 13 and 14, the inner row of chambers 12 having 10 chambers, the middle row of chambers 13 having 18 chambers, and the outer row of chambers 14 having 22 chambers.

In the preferred form: (a) the chambers have a cross-section with each side being 0.6 mm.; therefore, the cross-section of each chamber is 0.36 $mm^2$, (b) each chamber 12, 13 and 14 has two entrance openings at its upstream end, for example, chamber 13 has two entrance openings 15 and 16; (c) each of the entrance openings 15 and 16 has a rectangular cross-section, one pair of parallel sides being 0.45 mm. long and the other pair of parallel sides being 0.5 mm. long, so that the aggregate cross-section of the entrance openings for each chamber is 0.45 $mm^2$; and (d) the disc 11 has a thickness A of 1.75 mm.

Thus, it will be apparent that the number of chambers is considerably increased, when compared to my prior patents showing this general type of aerator, the cross-section of the chambers has been considerably decreased, and the aggregate cross-section of the entrance openings for a given chamber exceeds the cross-section of that chamber so that each chamber is flooded. For best results there should be at least 40 chambers 12, 13 and 14.

Figure 3:
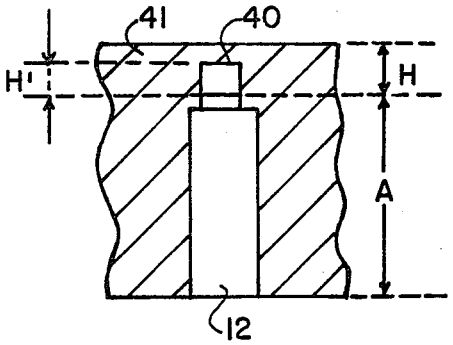
FIG. 3 is a cross-sectional view of a chamber topped by an entrance opening taken along line 3—3 of FIG. 4-in which H shows the height of the rib and H' the height of the entrance opening.

FIG. 3 is a side cross-sectional view of one of the chambers together with its entrance openings. The molded disc 11 includes a bridge 40 as an integral part of the disc 11. The bridges 40 are supported by annular ribs in-between said bridges 40, leaving the entrance openings 15 and 16 in communication with the chamber 12 and defining an entrance opening height H', H indicating the height of the rib 41. Similar bridges and in-between annular ribs are associated with the rows of chambers 13 and 14. Hence, all chambers and their associated entrance openings are substantially identical. The disc 11 together with its several parts 11*a*, 11*b*, 11*c*, 11*d*, 11*e* and 40 are molded in one piece of a suitable plastic.

A washer 17 with entrance holes 18 makes a pressed type fit on projections 11*e* of the disc 11 and may limit the flow of water into the aerator, if desired.

An air space is defined between casing 10 and skirt 11*a* forming an air passageway 19. The casing 10 may be attached to the faucet in any conventional manner, for example, by outside threads 20 which when screwed tightly into the inner threads of the faucet presses washer 17 against a ledge in the faucet to make the aerator water-tight, except that water passing through the faucet may flow through the holes 18, thence through the numerous entrance openings 15 and 16 to the chambers 12, 13 and 14, flooding those chambers, and discharging water from them in the form of streamlets having impaired coherence. These streamlets strike the screens 12 where final aeration takes place, and an aerated stream is discharged from the downstream end of the aerator. At the same time air is being drawn into the aerator via the air passages 19 and air openings lid. The air thus reaches the mixing space just below the chambers 12, 13 and 14, whereby air is available to combine with the streams of impaired coherence discharged from the chambers 12, 13 and 14.

The generic distinction of the present invention is that in an aerator of the type disclosed having a disc 11 whose thickness A is preferably 1.0 mm. or more but at least 0.75 mm., the disc 11 has at least 36 chambers such as 12, 13 and 14 of a cross-section less than 0.8 $mm^2$, each chamber being topped by a pair of entrance openings, with the aggregate size of the entrance openings being about equal or preferably greater than the cross-section of the chamber, to produce an aerator having less than 15 decibels at 3 atmospheres water pressure measured according to the procedure set forth in said documents. Discs built with chambers two to three mm. long gave satisfactory results.

I will next set forth several additional examples of my invention.

EXAMPLE 1

A disc 11 with a dimension A of 1.75 mm has 78 chambers 12, 13 and 14 and a plurality of concentric rows, each chamber having a square cross-section of 0.5 mm on each side to give a cross-sectional area of 0.25 $mm^2$. Each of the two entrance openings was also square and had dimensions of $0.4 \times 0.4$ mm, thus giving an cross-section for the two entrance openings combined of 0.32 $mm^2$. The noise produced by this aerator was 11.4 decibels and the rate of flow 16.3 liters per minute at a water pressure of three atmospheres. At 5 atmospheres the decibel level was 13.4 and the rate of flow 20.1 liters per minute.

EXAMPLE 2

An aerator whose disc 11 has a thickness A of 1.75 mm, had 86 chambers 12, 13 and 14 in concentric rows. Each chamber had a square cross-section of 0.5 mm on each side producing a cross-sectional area of 0.25 $mm^2$. There were two entrance openings to each chamber. Each of these entrance openings was 0.35 mm on each side giving a total cross-sectional area for each entrance opening of 0.1225 $mm^2$ or a total cross-sectional area for both the entrance openings of 0.245 $mm^2$. This aerator gave 15.8 liters per minute and had a noise level of 12 decibels at a water pressure of three atmospheres, measured according to the procedures set forth above. The same disc, built with only 78 chambers had a noise level, at 3 atmospheres of 14.6 decibels.

EXAMPLE 3

A disc 11 having a thickness A of 1.75 mm, had 40 chambers of square cross-section. Each chamber was 0.7 mm on each side for a cross-sectional area of the chamber of 0.49 $mm^2$. Each chamber had two entrance openings, each of which was square and was 0.5 mm on each side so that each entrance opening had a cross-sectional area of 0.25 $mm^2$, and both entrance openings combined had a cross-sectional area of 0.5 $mm^2$. This aerator gave 14.5 liters per minute and produced 15.6 decibels when the water pressure was 3 atmospheres and the measurements were taken as set forth above. At 5 atmospheres the decibel level rose to 24 and the rate of flow to 17.5 liters per minute.

The mere increase in the number of chambers together with a decrease in their cross-section will not lower the noise level of the aerator. For example, an aerator with 60 or 70 chambers with each chamber being square and 0.9 mm on each side, giving a total cross-sectional area of 0.81 $mm^2$ when provided with entrance openings substantially smaller than the cross-section of the chambers produced 18 decibels at 3 atmospheres of water pressure, when measured as described above. Substantially the same result was present when the size of the chambers was reduced to 0.8 mm on each side or 0.7 mm on each side. Similarly, a disc 11 built with 68 square chambers of 0.7 mm on each side topped by two entrance openings of $0.3\times0.3$ mm each, produced 19.1 decibels at a water pressure of 3 atmospheres and measured according to the foregoing procedure.

All of the aerators described in this application were adapted to fit on a standard kitchen faucet with inside threads and employed a disc approximately 20.75 mm. in diameter, measured along its largest diameter which is just above the ledge of the casing 10. In each test described, the water pressure in the pipe leading to the faucet was three and five atmospheres. All measurements were made according to the test procedures set forth in said documents.

Figure 5:
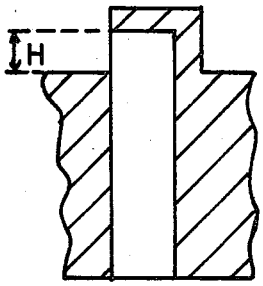
FIG. 5 shows a chamber with one entrance opening the size of which is not less than the cross-section of the chamber.
Figure 4:
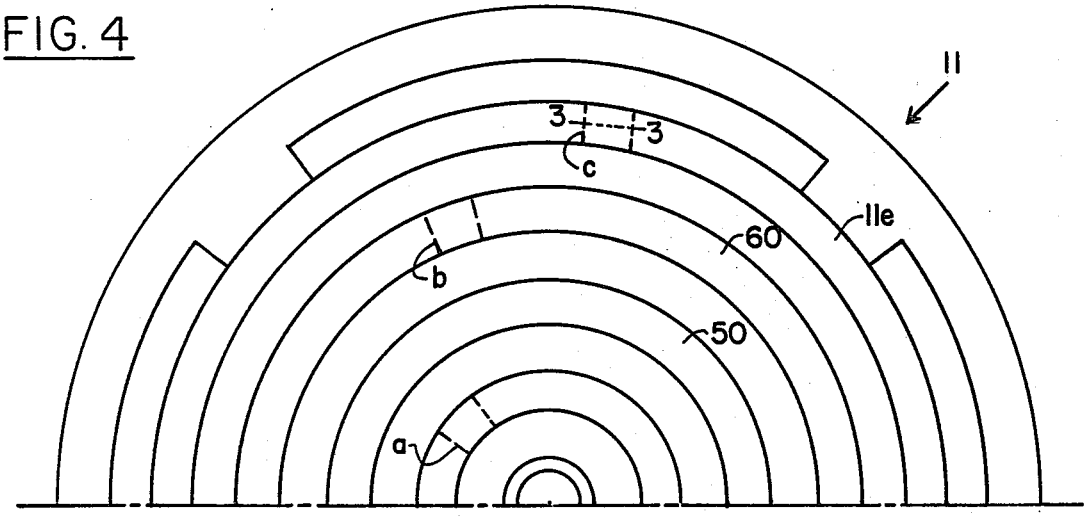
FIG. 4 is a top view of one-half of the disc 11 of FIG. 1, in which dotted lines a, b and c delineate each one of the bridges topping its corresponding chamber.

FIG. 5 shows an alternate form of chambers that may be used. Their height is at least 1.0 mm. and their cross section is square of about $0.7\times0.7$ mm., giving a cross sectional area of about 0.49 $mm.^2$. The chamber has only one entrance opening so that the water enters only through one side wall of the chamber to direct the water at another side wall of the chamber to thereby create turbulence in the chamber. Nevertheless, since the entrance opening has a cross sectional area about as large or larger than the cross section of the chamber, the chamber is flooded. The water discharged has impaired coherence. The entrance opening may be square and at least 0.7 mm. on each side, giving a cross sectional area of 0.49 $mm.^2$. There should be at least 40 of these chambers in the disc which is otherwise the same size as the disc described previously.

I claim to have invented:

1. In a faucet aerator of the type which employs an upstream disc having a multiplicity of chambers therein, the longitudinal dimensions of which chamber being parallel with the general direction of water flow, each chamber having a plurality of opposing entrance openings at the upstream end of the chamber, and screen means downstream of the chambers for mixing the water with air and discharging the water as a coherent jet containing numerous small bubbles, said aerator defining an air passage means extending from the atmosphere to the space between the chambers and the screen means, the improvement comprising:

said disc having at least 36 of said chambers, said chambers each having a length of at least 0.75 mm, and a cross-sectional area less than 0.8 $mm^2$, and each said chamber having at least two entrance openings, the aggregate cross-section of which entrance openings is about equal or exceeds the cross-section of the chamber to which the openings communicate, whereby to provide a low-noise aerator.

2. An aerator according to claim 1 in which the disc has a thickness of about 1.75 mm, the chambers are square and are about 0.6 mm on each side giving a total chamber cross-section of about 0.36 $mm^2$, and the chamber has two entrance openings the aggregate cross-section of which is about 0.4 $mm^2$.

3. A faucet aerator as defined in claim 1 in which the chamber has only two entrance openings positioned so that water passing through said entrance openings creates turbulence in the chamber.

4. In a faucet aerator a disc having at least 40 chambers of square cross section between its sides, each chamber having a cross section of less than 0.49 $mm.^2$, said chambers being topped by bridges open only on one of their sides, said single opening having a size at least equal to the cross section of the chamber, an air inlet leading downstream said disc and screen-means in the path of the jets issuing from said disc to break up said jets and mix them with air for producing a silent coherent bubbly stream.

5. An aerator according to claim 1 in which said aggregate cross section is about equal to the cross section of the chamber.

6. In a faucet aerator of the type which employs (a) an upstream disc having a multiplicity of chambers therein, the longitudinal dimension of each chamber being parallel with the general direction of water flow, each chamber having a bridge overlying such chamber and at least one entrance opening thereto at the upstream end of the chamber, and (b) screen means downstream of the chambers for mixing the water with air and discharging the water as a coherent jet containing numerous small bubbles, said aerator defining an air passage means extending from the atmosphere to the space between the chambers and the screen means, the improvement comprising:

said chambers each having a cross-sectional area less than 0.5 $mm^2$, each said chamber having at least one entrance opening thereto at the upstream end of the chamber, the aggregate cross-section of all of the at least one entrance openings being greater than the cross-section of the chamber to which the corresponding at least one openings communicate, and the number of chambers being large enough to provide sixteen liters of water per minute under water pressure at substantially three atmospheres, the number of the chambers and the cross-section of each chamber relative to the aggregate cross-section of the at least one openings thereto being defined such that the noise produced by the passage of water through the aerator is less than 15 decibels.

7. An improvement according to claim 6 having a bridge overlying each chamber, wherein the at least one entrance opening to each chamber includes two entrance openings defined below and to each side of the bridge which overlies each such chamber, the aggregate cross-section of the two openings to each such chamber being greater than the cross-section of each such chamber.

8. An improvement according to claim 6 having a bridge overlying each chamber, wherein the at least one entrance opening to each chamber includes only a single entrance opening defined below and to one side of the bridge which overlies such chamber, the cross-section of the single opening to each chamber being greater than the cross-section of such chamber.

9. An improvement according to claim 6 wherein the aggregate cross-section of all of the at least one entrance opening exceeds the cross-section of the chamber to which the corresponding at least one openings communicate.

* * * * *